United States Patent [19]

McIntosh

[11] 3,956,599

[45] May 11, 1976

[54] DOME LOUDSPEAKER

[76] Inventor: Frank H. McIntosh, 3720 Pheasant Lane, Endwell, N.Y. 13760

[22] Filed: Jan. 17, 1975

[21] Appl. No.: 542,030

[52] U.S. Cl. ..... 179/115.5 R; 179/115.5 VC; 179/180

[51] Int. Cl.[2] ..... H04R 9/04; H04R 9/06

[58] Field of Search..... 179/115.5 R, 115.5 SF, 179/115.5 BS, 117, 119 R, 120, 180; 335/231; 29/594

[56] References Cited

UNITED STATES PATENTS 1,805,459 5/1931 Batcher..... 179/115.5 R

*Primary Examiner*—Kathleen H. Claffy

*Assistant Examiner*—George G. Stellar

*Attorney, Agent, or Firm*—Elliott I. Pollock

[57] ABSTRACT

A dome loudspeaker including a yoke assembly consisting of a flat plate having an opening and a U-shaped member having its arm ends secured to the flat plate, a cylindrical magnet being secured to the cross arm of the U-shaped member adhesively, the cavity formed by the U-shaped member being packed with fiberglass pads and sealed by end plates, a flexible dome being secured adhesively to a voice coil wound on an aluminum form and these being secured to a mounting plate, which is arranged to be precisely spatially related to the yoke assembly, with intervening padding of fiber-glass to provide damping, the dome being covered with a perforated cover separated from the dome by a fiber-glass pad.

9 Claims, 7 Drawing Figures

FIG.1
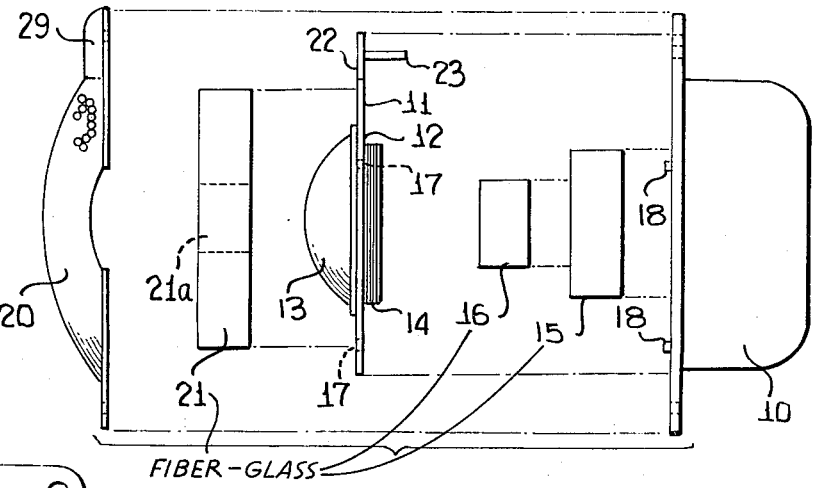
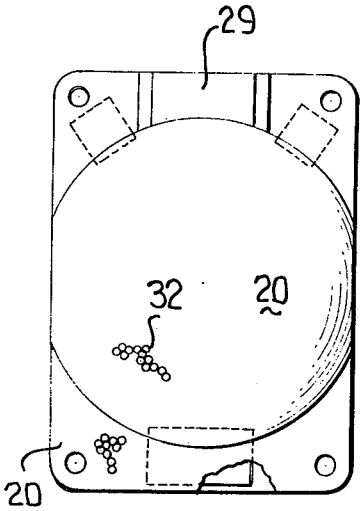
FIG.3
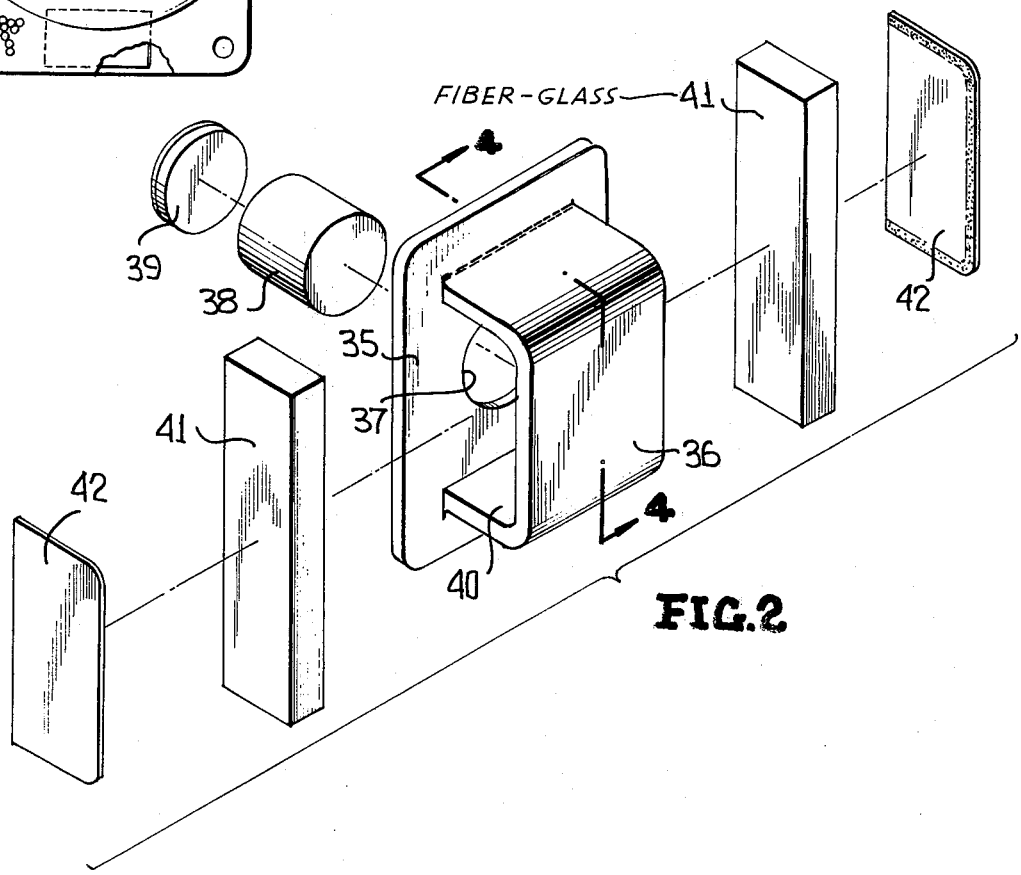
FIG.2

FIG.4
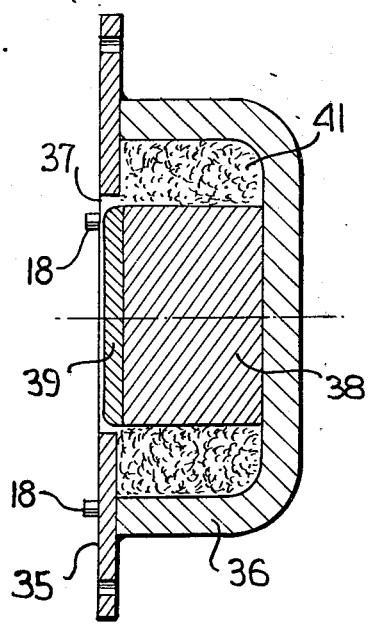
FIG.5
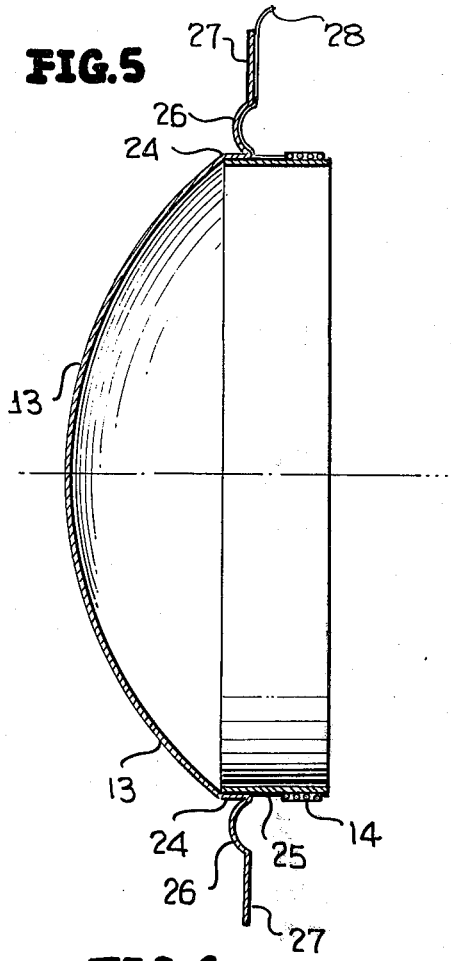
FIG.6
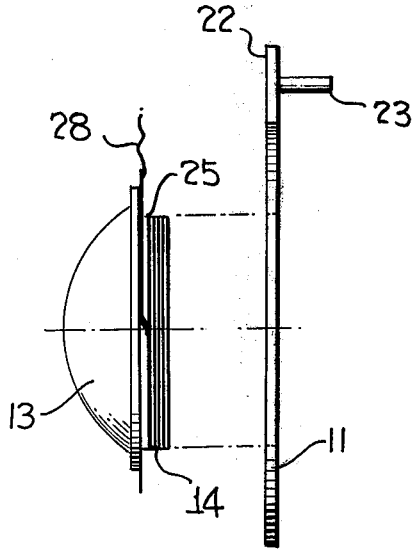
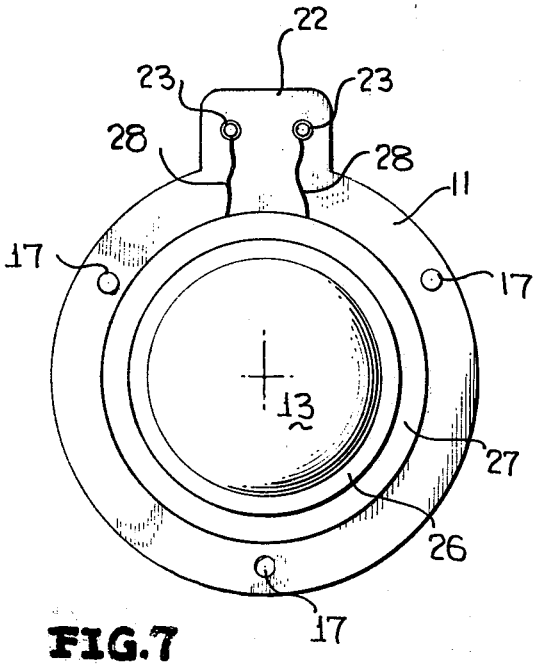
FIG.7

DOME LOUDSPEAKER

BACKGROUND OF THE INVENTION

Dome loudspeakers are well known in the art. A typical such speaker is that disclosed in the U.S. Pat. to Hecht, No. 3,328,537, issued June 27, 1967. That patent employs a spider of rubber-like material, which is highly compressible and lies on top of a pole piece, and has legs extending downwardly along the pole piece. The spider is embraced by a voice coil, which is attached to a dome radiator, and the spider permits excursions of the voice coil. The structure is essentially undamped and, therefore, has resonances, and because of the spider structure, the voice coil and dome are capable of only slight excursions. Further, in Hecht, a voice coil is secured to a flange extending from the dome radiator, by cementing a few turns of the voice coil to the flange, but the voice coil is otherwise unmounted. The voice coil is therefore readily deformable or detachable from its mounting flange, in response to large pulses.

In accordance with the present invention, the coil is wound on a metallic non-magnetic form which is cemented over a large area joint directly to the dome, and no separate spider is employed. The voice coil itself is well spaced from the dome, and is, therefore, located in a maximum area of uniform magnetic flux, and greater excursions of the dome are achievable, with complete safety, than is possible in the case of the Hecht device. Further, the dome itself is fabricated of paper, having no interstices. The dome is damped both exteriorly and interiorly by fiber-glass packing, to avoid reasonances.

SUMMARY OF THE INVENTION

A dome loudspeaker having an enclosure formed by a magnet and yoke assembly which is packed with fiber-glass, and having a dome formed of paper and having a corrugated annular extension secured to a solid mounting, to enable extensive motion of the dome with respect to the yoke assembly, the voice coil of the speaker being wound on a metallic cylinder which in turn is directly adhered to the dome, both the interior and the exterior of the dome being packed with fiber-glass.

DESCRIPTION OF THE DRAWINGS

FIG. 1 is an exploded view in side elevation of the several components which are assembled to form a loudspeaker according to the invention;

FIG. 2 is an exploded view in perspective of a yoke and magnet assembly, used in the system of FIG. 1;

FIG. 3 is a plan view of a cover plate, included in FIG. 1;

FIG. 4 is a view in transverse section taken on the line 4—4 of FIG. 2;

FIG. 5 is a view in section of a dome radiator and coil assembly employed in the speaker of FIGS. 1–3;

FIG. 6 is a disassembled view in side elevation of a dome and of its mounting plate, employed in the speaker of FIG. 1; and FIG. 7 is a plan view of the structure of FIG. 6.

DETAILED DESCRIPTION OF THE INVENTION

Referring to FIG. 1 of the accompanying drawings, 10 is a magnet assembly for a dome loudspeaker. Secured to the magnet assembly 10 is a mounting ring 11, having a central opening 12, in which is secured a dome radiator 13 and a voice coil 14, secured to the dome radiator 13. Located between the magnet assembly 10 and the concave side of radiator 13 are two pads of fiber-glass 15 and 16. The mounting ring assembly has three small openings 17, which fit over nipples 18 on the magnet assembly which serve jointly to precisely locate the mounting ring 11 with respect to the magnet assembly 10. A perforated cover plate 20, having a concave configuration is secured over the radiator 13, and is separated from the radiator 13 by a fiber-glass pad 21, having a central aperture 21*a*. The magnet assembly 10 has dimensions of 3 inches × 4 inches, overall. The radiator 13 is fabricated of resilient paper of appropriate stiffness or resilience, as is usual in the art of loudspeakers generally.

The mounting ring 11 includes a tab extension 22, (FIGS. 1, 6 and 7), to which are secured a pair of terminal pins 23.

The dome radiator 13 and its voice coil 14 are illustrated in detail in FIG. 5 of the accompanying drawings. The radiator 13 includes an annular skirt 24, to which is connected a light nonmagnetic metallic cylindrical coil support 25. The voice coil 14 is wound on the support 25, well spaced from the skirt 24, and is cemented to the skirt. From the skirt 24 extends an annular corrugation 26 and a flat annular extension 27, the dome radiator 13 and the corrugation 26 and extension 27 being integral or of one piece design. Leads 28 extend from the voice coil 14 to the terminal pins 23 (FIGS. 1 and 7), the cover plate 20 being provided with a rise 29 (FIGS. 1 and 3) to accommodate the tops of the pins 23 and the tab 22. The apertured pad 21 then assures that sound will be radiated entirely via the perforations 32 in the cover plate 20, and the configuration of the cover plate assures that it will be correctly covered with respect to the mounting ring 11.

The magnet assembly 10 is illustrated in detail in FIGS. 2 and 4 of the accompanying drawings, and includes a pole plate 35, to which is secured a keeper 36, the plate 35 including a circular opening 37, through which extends a cylindrical slug magnet 38 leaving clearance for voice coil 14, and on the free end of slug magnet 38 is secured a pole cap 39. As best shown in FIG. 4, the innermost end of slug magnet 38 engages and is secured to the inner face of keeper 36, and the pole cap 39 secured to the other end of magnet 38 is positioned within opening 37 in spaced coaxial relation to said opening 37 to provide an annular clearance for reception of voice coil 14, with the free surface of pole cap 39 extending parallel to the faces of pole plate 35. The keeper 36 is U-shaped and its arms are welded to pole plate 35. Through the open sides 40 of the keeper 36 are inserted fiber-glass pads 41, which surround the slug 38. The open sides 40 are then sealed by end plates 42, so that the entire cavity containing the slug 38 is sealed and heavily damped acoustically, removing cavity resonances.

What I claim is:

1. A dome loudspeaker, including a permanent magnet, a pole plate, a U-shaped keeper having arms welded to said pole plate and open sides formed by said arms, closure plates for said open sides, a dome, a voice coil secured to said dome, said voice coil extending between said permanent magnet and said pole plate, and means securing said dome at its edges to said pole plate.

2. The structure of claim 1 including acoustic damping material disposed about said permanent magnet within the enclosure formed by said keeper, said pole plate, and said closure plates.

3. The structure of claim 2 wherein said permanent magnet is of substantially cylindrical configuration, one end of said cylindrical magnet engaging said keeper and the other end of said cylindrical magnet being disposed closely adjacent said pole plate in spaced relation thereto.

4. The structure of claim 1 wherein said voice coil extends around the peripheral edge of said dome.

5. The structure of claim 4 wherein said voice coil is wound about a cylindrical coil support, said coil support having substantially the same diameter as said dome and being secured to the peripheral edge of said dome.

6. The structure of claim 1 wherein said means for securing said dome to said pole plate includes means for accurately locating said dome relative to said pole plate.

7. The structure of claim 6 whrein said securing means includes a ring-shaped mounting plate for attaching said dome to said pole plate, said locating means comprising a plurality of spaced projections outstanding from one of said plates and a plurality of complementarily shaped and positioned apertures in the other of said plates.

8. The structure of claim 1 including fiber-glass packed into both the interior of, and about the exterior of, said dome.

9. A dome loudspeaker comprising a magnet assembly, said magnet assembly including a pole plate, a U-shaped keeper having arms secured to said pole plate and open sides formed by said arms, said pole plate including a central circular opening, a cylindrical slug magnet coaxial with said opening, one end of said magnet being in engagement with said U-shaped keeper, a pole cap secured to the other end of said slug magnet, said pole cap being disposed in coaxial spaced relationship with said opening and having a free surface parallel to said pole plate, end plates secured to the open sides of said keeper to form an enclosure for said slug magnet, acoustic damping material located within said enclosure around said slug magnet, a mounting ring on said pole plate, a pair of terminal pins on said mounting ring, a dome radiator, said dome radiator having integral therewith an annular flange, a coil support secured to said annular flange, a voice coil wound on said coil support and having leads extending to said pair of terminal pins, the periphery of said dome radiator further including an integral annular corrugation and a flat annulus located outwardly of said annular corrugation, said flat annulus being secured to said mounting ring, said voice coil extending between said pole cap and said pole plate coaxially with said opening in said pole plate, a perforated cover plate for said dome radiator, acoustic damping material located interiorly of said dome radiator between said dome radiator and said pole cap, and acoustic damping material located exteriorly of said dome radiator between said dome radiator and said perforated cover plate.

* * * * *